US010441981B2

(12) United States Patent
Wouters

(10) Patent No.: US 10,441,981 B2
(45) Date of Patent: Oct. 15, 2019

(54) METHOD AND SYSTEM FOR CLEARING A PIPE SYSTEM

(71) Applicant: FLUIDOR EQUIPMENT B.V., Raamsdonkveer (NL)

(72) Inventor: Robbert Christianus Antonius Wouters, Raamsdonkveer (NL)

(73) Assignee: FLUIDOR EQUIPMENT B.V., Raamsdonkveer (NL)

( * ) Notice: Subject to any disclaimer, the term of this patent is extended or adjusted under 35 U.S.C. 154(b) by 0 days.

(21) Appl. No.: 15/767,184

(22) PCT Filed: Oct. 14, 2016

(86) PCT No.: PCT/EP2016/074791

§ 371 (c)(1),
(2) Date: Apr. 10, 2018

(87) PCT Pub. No.: WO2017/064293

PCT Pub. Date: Apr. 20, 2017

(65) Prior Publication Data

US 2018/0297089 A1 Oct. 18, 2018

(30) Foreign Application Priority Data

Oct. 14, 2015 (NL) ..... 2015613

(51) Int. Cl.
*B08B 9/032* (2006.01)
*F17D 3/10* (2006.01)
(Continued)

(52) U.S. Cl.
CPC ..... *B08B 9/0325* (2013.01); *B08B 9/0327* (2013.01); *B08B 9/0328* (2013.01);
(Continued)

(58) Field of Classification Search
CPC ... B08B 9/0325; B08B 9/0327; B08B 9/0328; B08B 5/02–026; B08B 5/04; F17D 3/10;
(Continued)

(56) References Cited

U.S. PATENT DOCUMENTS 5,127,961 A * 7/1992 Aiton ..... B08B 3/003 134/113
5,238,030 A * 8/1993 Miller ..... F17C 5/007 137/80

(Continued)

FOREIGN PATENT DOCUMENTS

DE 102008048710 A1 9/2008
EP 1872877 A1 * 1/2008 ..... B08B 9/032

(Continued)

OTHER PUBLICATIONS

Japanese Office Action for family member application, dated Nov. 13, 2018 (with English translation).

*Primary Examiner* — Robert J Scruggs
(74) *Attorney, Agent, or Firm* — Hudak, Shunk & Farine Co. LPA

(57) ABSTRACT

Method and system for clearing a pipe system from its contents, the pipe having a proximal end and a distal end, the method including providing an air supply to the pipe system at the proximal end by applying an air pressure decreasing from an initial pressure as the bulk of the pipe contents get discharged gradually at the distal end for obtaining a contents flow in the pipe system. The method further includes determining a volume of air supplied to the pipe system by the air supply, determining an estimated contents travel speed from the volume of the air supplied to the pipe and regulating the air supply to the proximal end of the pipe for obtaining a predetermined pipe contents travel speed using the estimated contents travel speed.

19 Claims, 5 Drawing Sheets

(51) Int. Cl.
*F17D 5/00* (2006.01)
*F17D 3/12* (2006.01)

(52) U.S. Cl.
CPC ..... *F17D 3/10* (2013.01); *F17D 5/00* (2013.01); *F17D 3/12* (2013.01)

(58) Field of Classification Search
CPC ... F17D 5/00; F17D 3/12; B43L 21/02; H01L 21/67028; H01L 21/67051
USPC ..... 15/303
See application file for complete search history.

(56) References Cited

U.S. PATENT DOCUMENTS 5,628,349 A * 5/1997 Diggins ..... F17C 5/06 141/3
2013/0068313 A1* 3/2013 George ..... F16K 37/0041 137/14

FOREIGN PATENT DOCUMENTS

| | | | |
|---|---|---|---|
| EP | 2684620 | A1 | 2/2008 |
| EP | 2674228 | A1 | 6/2012 |
| JP | H11304099 | A | 11/1999 |
| JP | 2008238119 | A * | 10/2008 |
| WO | 0117700 | A1 | 3/2001 |

* cited by examiner

METHOD AND SYSTEM FOR CLEARING A PIPE SYSTEM

FIELD OF THE INVENTION

The invention relates to a method and system for clearing a pipe system.

BACKGROUND OF THE INVENTION

Pipe systems are used in industrial environments, for example food industry or oil industry, for transporting contents like raw materials, half products or end products to various stages in corresponding processes. Such pipe systems need periodic cleaning and therefore the pipe system contents, i.e. the product need to be cleared from the pipe system. After clearing the pipe system, cleaning can be performed. Such cleaning is in the art also referred to as 'Cleaning In Place' (CIP).

While clearing the pipe system, the cleared contents are preferably preserved for later use or recycling in the process in which the pipe system is used. For this reason is it advantageous to clear the pipe before cleaning by pushing out the pipe system contents using a air. Usually compressed air is used, but dependent on the contents, other gasses may be applicable.

In the art it is known that clearing a pipe system can be performed by blowing out the pipe system contents in a push phase, wherein high pressure air is applied at a pipe system proximal end such that the pipe contents are set in motion. When most of the contents are cleared from the pipe system, a constant air flow in a blow phase will remove the remaining contents which adhered to the pipe system walls, after which the pipe system can be rinsed and dried in respective rinse and dry phases.

Clearing the pipe system in the push phase requires adequate pressure and speed. When the pressure is too low, the air used for expelling the contents tends to flow over the pipe system contents and find its way to an distal end. Thereby contents are left inside the pipe system.

When the pressure is too high, the air can push through the pipe contents, creating so called 'rat holes' i.e. passages through the contents.

Adequate initial pressure and pressure profile in time of the compressed air in the push phase can determined from contents viscosity, pipe diameter and architecture, and can also be determined from experience. The air pressure profile in time and consequential flow, once the air is released in the push phase, also determines adequate expelling of the pipe system contents.

In the art, a predetermined air pressure profile is released upon the pipe system contents, starting at an initial pressure, decreasing to an end pressure. The push phase is ended when the end pressure is reached, i.e. the pressure drops below a threshold value, or when the push phase is timed out. In these cases the pressures and pressure profiles are chosen such that at the end of the push phase a sufficient normalized amount of the contents has been cleared. In other cases the push phase is ended when a sudden unexpected pressure drop is detected. In the latter case, the pipe system contents were completely expelled prematurely.

When an insufficient normalized amount of contents have been cleared, or when the push phase end prematurely relatively large normalized amounts of contents remain in the pipe system. Consequently an extensive blow phase is required to eventually clear the pipe system of its contents.

When too much contents are cleared from the pipe system in the push phase, compressed air may undesirably enter a container used for capturing contents removed from the pipe system, i.e. product, thereby causing overpressure in such a container and consequently obstructing filling of the container.

As a pipe system may comprise many product feed line or pipes, each of which have to be cleared during production, and wherein pipes are made from opaque materials such as stainless steel, it is not possible to follow the pipe content while it is being cleared from the pipe. Thus completion of the clearing of the pipe system is uncertain.

SUMMARY OF THE INVENTION

It is an object of the invention to provide clearing of a pipe system from contents without the disadvantages described above.

The object is achieved in a method of clearing a pipe system from its contents, the pipe having a proximal end and a distal end, the method comprising providing an air supply to the pipe system at the proximal end by applying an air pressure decreasing from an initial pressure as the bulk of the pipe contents get discharged gradually at the distal end for obtaining a contents flow in the pipe system. The method further comprises determining a volume of air supplied to the pipe system by the air supply, determining an estimated contents travel speed from the volume of the air supplied to the pipe and controlling the air supply to the proximal end of the pipe for obtaining a predetermined pipe contents travel speed using the estimated contents travel speed.

By determining the air volume supplied to the pipe system, and simultaneously controlling the air supply to create a constant contents flow, the pipe system is effectively cleared without air overflowing the contents and without creating air passages in the contents. The contents travel speed can be set dependent on the contents, i.e. the viscous product in the pipe system.

By more effectively clearing the pipe system in the push phase, energy is saved in the blow phase, as less blowing activity is required to clear the remaining contents.

In an embodiment, the controlling the air flow at the proximal end of the pipe comprises controlling a regulation valve between the air supply and the proximal end of the pipe.

In an embodiment, the controlling the air supply to the proximal end of the pipe system comprises using a difference between the estimated contents travel speed and a preset contents travel speed value. This effectively allows the contents to be travelling in the pipe system at a predetermined preset speed.

In an embodiment, the controlling the air flow at the proximal end of the pipe system comprises controlling a regulation valve between the air supply and the proximal end of the pipe system. The controllable valve allows continuous real time control of the air supply into the pipe system, thus the contents travelling speed can be maintained constant at the preset speed.

In an embodiment, the air supply comprises a compressed air container having a container volume. This is advantageous since the compressed air required for the clearing of the pipes can be loaded into the compressed air container which is then available for fast release in the push phase, alleviating compressed air sources from providing large quantities of compressed air at once.

In an embodiment, the determining a volume of air supplied to the pipe system comprises measuring a pressure in the compressed air container, and measuring a pressure at the proximal end of the pipe system, and calculating the air volume supplied to the pipe system from a pressure difference in the air container between an initial pressure and a pressure in the air container after supplying air from the air container to the pipe system, the air container volume, and a pressure at the proximal end of the pipe system after the supplying of the air into the pipe system.

Using this scheme, the volume passed into the pipe system is simply determined using pressure sensors. Thus expensive air flow meters are obviated, and no sensors are required to detect the air front pushing the contents through the pipe system.

In an embodiment, the determining a volume of air supplied to the pipe system further comprises compensating the volume of air supplied to the pipe system for a supply line volume, and an expansion of the air volume stored in the supply line prior to the supplying of the air to the pipe system.

Accuracy in determining the air volume in the pipe system volume is thereby improved also for pipe clearing systems having an air supply line of substantial dimensions between the air supply and pipe system. Consequently position and speed of the air front pushing the pipe system contents are improved.

In an embodiment, the determining an estimated contents travel speed from the volume of the air supplied to the pipe system comprises determining a position of an air-contents front in the pipe system from the volume of air supplied to the pipe system by compensating volume of air supplied to the pipe system with a pipe system diameter.

This allows the position of the air-contents front to be controlled. The air supply can for example be cut off when the air-contents front approaches the pipe system distal end. This prevents blow out of the pipe system, i.e. air pushed into a container capturing contents pushed out of the pipe system to be prevented. This further allows the speed of the air front pushing the pipe contents to be determined and to be controlled in a further step.

In an embodiment, the determining an estimated contents travel speed from the volume of the air supplied to the pipe system further comprises calculating at least two positions of the air-contents front at at least two corresponding points in time and calculating the estimated contents travel speed from the difference in the at least two positions and the time difference between the at least two respective points in time.

Thereby the contents travel speed in the pipe system is determined without inspection, i.e. sensors, in the pipe system itself.

The object is also achieved in a system for clearing contents from a pipe system, the pipe system having a volume, a proximal end and an distal end, the system comprising an air supply connected to the pipe system proximal end for supplying air to the pipe system at the proximal end, wherein an air pressure decreases from an initial pressure as the bulk of the pipe system contents get discharged gradually at the distal end for obtaining a contents flow in the pipe system, volume determining means for determining an air volume supplied by the air supply, and calculating means for determining an estimated contents travel speed from the volume of the air supplied to the pipe system, and control means being arranged for regulating the air supply to the proximal end of the pipe system for obtaining a predetermined pipe contents travel speed using the estimated contents travel speed.

In an embodiment, the control means are arranged for regulating the air supply to the proximal end of the pipe system comprises using a difference between the estimated contents travel speed and a preset contents travel speed value.

In an embodiment, the control means comprise a controllable valve for controlling the air supply to the proximal end of the pipe system and a controller, controllably connected to the controllable valve. This allows the supply of air into the pipe system to be controlled.

In an embodiment, the controller comprises a PID-controller. This allows effective, responsive control of the contents speed without offset.

In an embodiment, the air supply comprises a compressed air container having a container volume. The system can be self-sufficient and needs not be connected to an external compressed air supply.

In an embodiment, the volume determining means comprise a first pressure sensor for measuring a pressure in the compressed air container, and a second pressure sensor for measuring a pressure at the proximal end of the pipe system, wherein the volume determining means are arranged further for calculating the air volume supplied to the pipe system from a pressure difference in the air container between an initial pressure and a pressure in the air container after supplying air from the air container to the pipe system, the air container volume, and a pressure at the proximal end of the pipe system after the supplying of the air into the pipe system.

This allows air volume supplied to the pipe system be determined without the need for air flow sensors.

In an embodiment, the volume determining means are further arranged for compensating the air volume supplied to the pipe system for a volume of a supply line to the pipe system and an expansion of air in the supply line prior to supplying the air into the pipe system.

In an embodiment, the calculating means for determining an estimated contents travel speed from the volume of the air supplied to the pipe system are further arranged for determining a position of an air-contents front in the pipe system between the supplied air and the contents in the pipe system from the volume of the air supplied to the pipe system and a pipe system cross section area.

In an embodiment, the calculating means for determining an estimated contents travel speed are further arranged for calculating at least two positions of the air-contents front in the pipe system at at least two corresponding time points, calculating the estimated contents travel speed from a difference between the at least two positions at the at least two points in time and a time difference between the respective at least two point in time.

The invention will now be elucidated by the following drawings.

DETAILED DESCRIPTION OF THE INVENTION

The invention will be further elucidated by the following description of exemplary embodiments.

Figure 1:
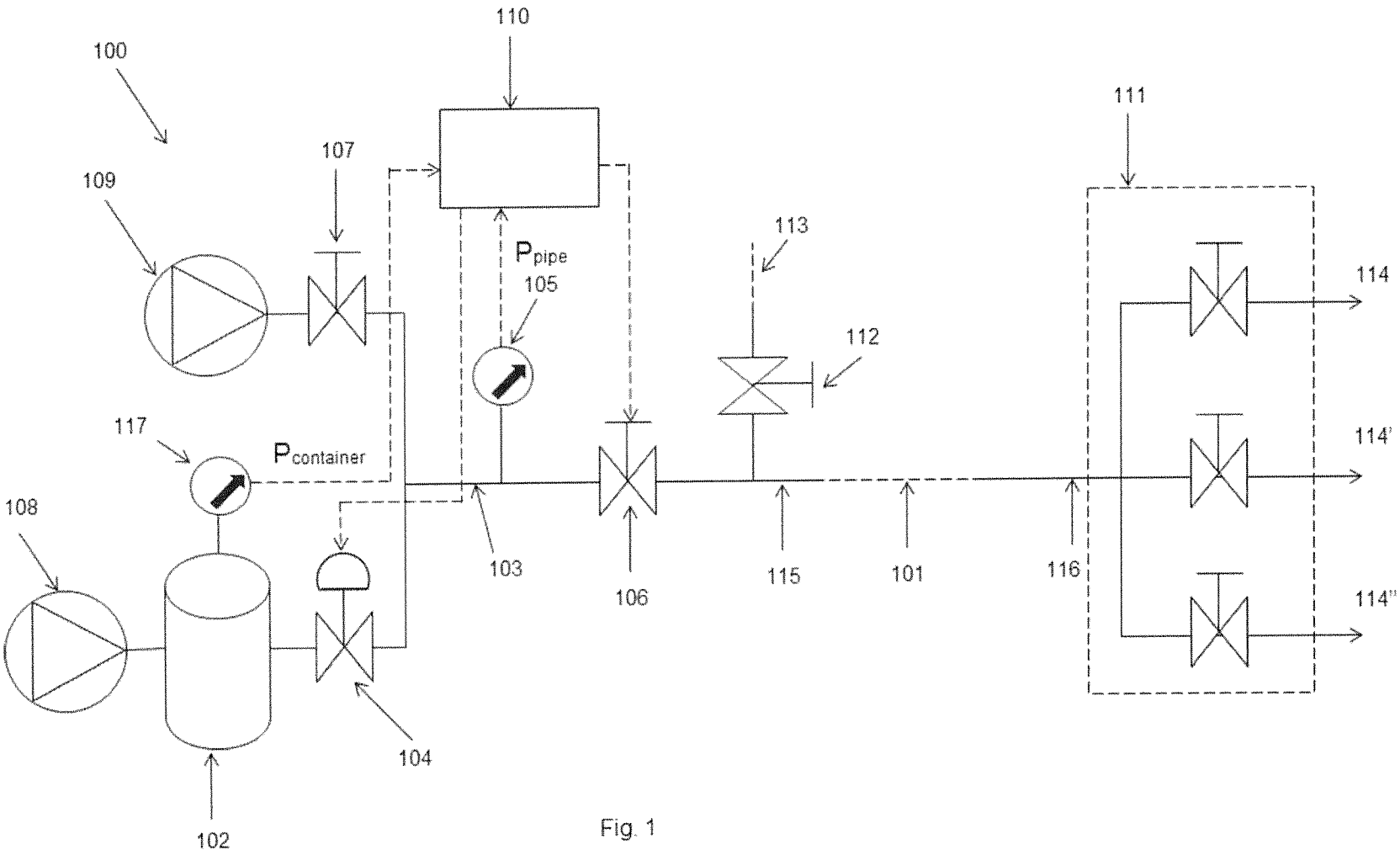
FIG. 1 shows a schematic diagram of a system for cleaning a pipe according to an embodiment of the invention.

In FIG. 1 a system 100 is shown for clearing a pipe system 101 from its contents. The pipe system 101 can be supplied with liquid viscous product via line 113, which can be shut off by valve 112. The pipe system 101 has a proximal end 115 near valve 106 and a distal end 116 near an outlet manifold 111. The outlet manifold provides various outlets 114, 114', 114" for example for connecting to a further process, a container for content cleared from the pipe system 101, or a separator for separating content from air or rinse fluids used for clearing the pipe system 101. The pipe system 101 can comprise at least one pipe which may be a one-segment pipe. The pipe system 101 may also comprise for example a multi-segmented, bent, curved, bifurcated pipes or a ramification of pipes. The pipes and/or segments may run in different directions, including horizontal, oblique and vertical directions. Furthermore, the pipes or pipe segments in the pipe system 101 can have cross sections of arbitrary dimensions and/or shapes. There may also be segments in the same pipe system having different cross sections and cross section shapes.

Contents transported in pipe system 101 can relate to viscous, low-viscous or non-viscous products which adhere to the pipe system walls. These products can be finished products, half-products or raw materials used in various industrial processes as can be utilized in petrochemical industry or food industry. The products may be smooth, but may also contain particles and/or solid fractions.

The system 100 for clearing the pipe system 101 comprises a compressed air container 102, a supply line 103, a regulation valve 104 for controlling a compressed air flow from the compressed air container 102 to the pipe system 101, a compressor 108, a blower 109 connected to the supply line 103 via controllable valve 107. The air used is for example compressed air. A pressure sensor 105 is connected to the supply line 103. The supply line 103 may connect to the pipe system 101 via valve 106. The various valves 104, 107, 106, 112, 114-114", compressor 108 and blower 109 are controlled by control unit 110. Outlet manifold 111 can be formed by for example a three-way valve or separate valves 114, 114', 114" connected to the distal end 116 of the pipe system 101. The valves 114, 114', 114" can be controlled by control unit 110 such that only a single valve is allowed to be opened while the remaining valves are closed. The blower 109 can for example be a claw pump, a screw pump or a side channel blower. The compressor 108 can be any type suitable air compression pump for filling compressed air container 102 with sufficient capacity for filling the container and at a sufficient pressure for allowing the compressed air container 102 to perform the moving of the pipe system contents.

Figure 1A:
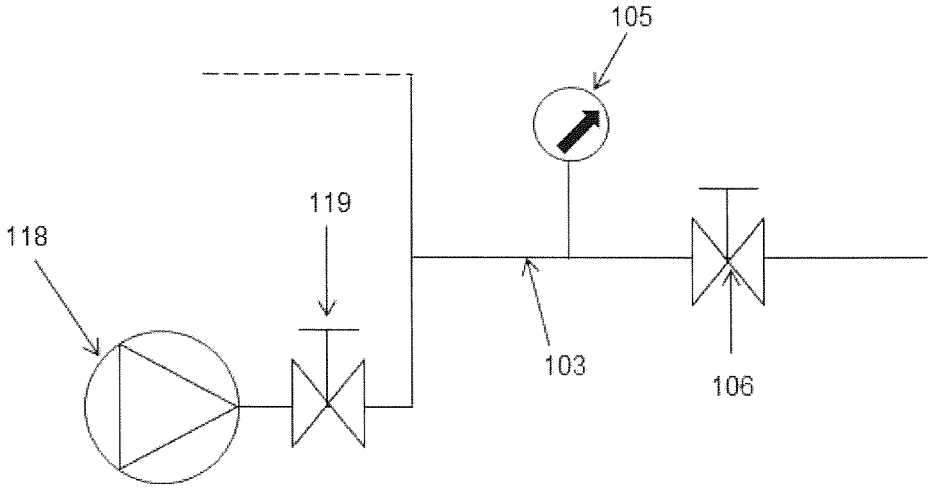
FIG. 1*a* shows a partial schematic diagram of a system for cleaning a pipe according to an embodiment of the invention.

As an alternative to the compressor 108, the compressed air container 102 may be connected to a main compressed air supply which is usually available in food, petrochemical or other industry. Furthermore, the air container 102 and regulation valve 104 can be supplemented or replaced by a high pressure low volume compressor 118 as shown in FIG. 1*a*. The high pressure low volume compressor 118 is connected to the air supply line 103 via a valve 119. The high pressure low volume compressor 118 can be controlled by the control unit 110 to provide the required pressure measured by pressure sensor 105 for performing the push phase.

Figure 4A:
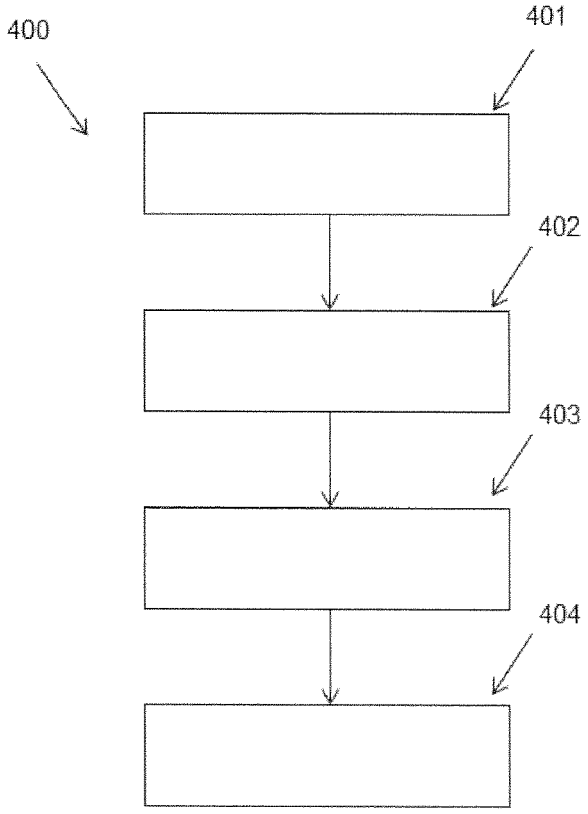
FIG. 4*a* shows a block diagram of a method of clearing a pipe from its contents according to an embodiment of the invention.

The process of clearing the pipe system 101 has four phases as is depicted in FIG. 4*a*. The first phase is the push phase 401, wherein a high pressure generated from compressed air container 102 and controlled by regulation valve 104 is applied to the proximal end 115 of the pipe system 101. The pressure $P_{container}$ is measured by pressure sensor 117, which value is communicated to the control unit 110. Control unit 110 controls controllable valve 106, such that the pressure in the supply line 103 is applied to the proximal end 115 when the pressure has reached a pre-set level.

When valve 106 is opened, air from compressed air container 102 pushes the contents of pipe system 101 towards to distal end 116 of the pipe system 101 wherein the outlet manifold 111 is set such that at least one of the outlet 114, 114', 114" is open to allow the contents being pushed out of the pipe system 101 to be removed. The contents may for example be collected for re-use.

The pressure $P_{container}$ measured by pressure sensor 117 and the pressure $P_{pipe}$ measured by pressure sensor 105 is used to control regulation valve 104 to create a decreasing pressure in time at the proximal end 115 of the pipe system 101. The controlling by control unit 110 is arranged to cause contents in the pipe system 101 to continue moving towards the distal end 116 at a constant speed. The push phase 401 ends when the contents are sufficiently removed from the pipe system 101. Preferably the end of the push phase 401 is alternatively determined by calculating a position of an air front in the pipe and establish that the air front is near the distal end 116 of the pipe system 101. This air front is the interface of the air released from the compressed air container 102 into the pipe system 101 with the contents to be pushed out. Alternatively, as a safeguard, the sufficient removal of the contents can be detected by a sudden pressure drop measured by pressure sensor 105, indicating that the compressed air can escape from the pipe system without blocking by contents within the pipe system 101.

The control unit 110 is arranged to estimate the position of the air-contents front from the measured pressure $P_{pipe}$ at the proximal end 115 by pressure gage 105. When the control unit 110 has determined that the air front is near the distal end 116 of the pipe system 101, corresponding to a position wherein for example at least 85% of the contents is pushed out of the pipe system 101, then regulation valve 104 is closed. Thereby the push phase 401 of FIG. 4 ends.

A new phase 402 of blowing the pipe system 101 is entered by starting blower 109 and opening valve 107 whilst valve 106 is kept open. In the blow phase 402, the blower 109 provides an air flow in pipe system 101 such that any contents left behind on the pipe system walls during the push phase 401 is blown out. The blow phase 402 is usually performed during a preset time period and timed by control system 110. The preset time period depends on the size and length of the pipe system, the viscosity of the contents, temperature, etc.

When the blow phase 402 is completed, the pipe system 101 can be rinsed in a rinse phase 403. In the rinse phase 403, the blower 109 blows air into the pipe system 101, while simultaneously rinse fluid is injected in the supply line 103 connecting the blower 109 to the valve 106 and proximal end 115 of the pipe system 101. The rinse fluid is for example water.

Following the rinse phase 403 the blower 109 is used for providing constant air flow through the rinsed pipe system 101 for drying in a drying phase 403.

Figure 4B:
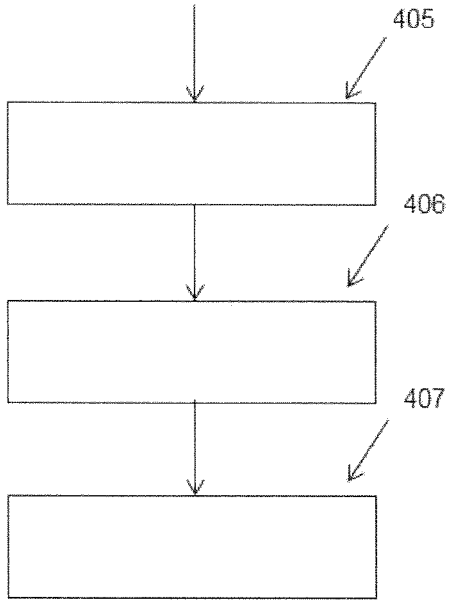
FIG. 4*b* shows a block diagram of a method of clearing a pipe from its contents according to a further embodiment of the invention.

In FIG. 4*b* an extra cleaning phase 405 is shown following drying phase 404. De cleaning phase 405 is similar to the rinse phase 403, wherein cleaning agents or disinfectants can be added to the rinse fluid. The cleaning phase 405 can be followed by an additional rinse phase 406 and/or drying phase 407.

Figure 2:
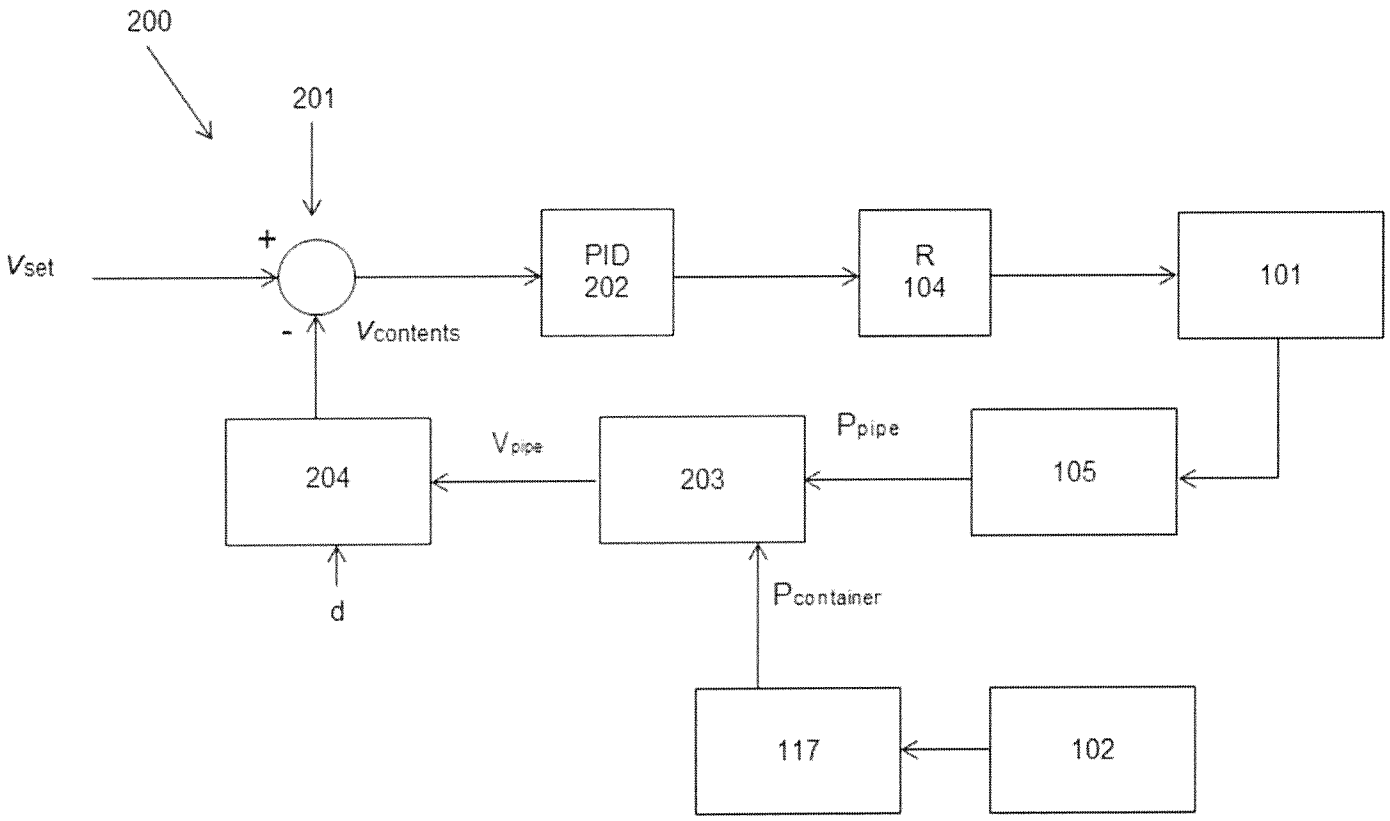
FIG. 2 shows a block diagram of a method of controlling the system of FIG. 1 according to the invention.

In FIG. 2 a block diagram is shown of a control system 200 which is active in the push phase for controlling the pipe contents travel speed $V_{contents}$. The functions 202, 203, and 204 shown in the block diagram 200 described below are performed in control unit 110, to which the container pressure sensor 117 and the pipe system pressure sensor 105 are connected.

The pipe contents travel speed $V_{contents}$ is controlled by regulating an airflow from the compressed air container 102 into the pipe system 101 using a controlled valve 104 to obtain the set value $V_{set}$. Thus a pipe contents travel speed $V_{contents}$ can be maintained which is sufficiently high for removing the pipe contents from the pipe system 101, and sufficiently low to prevent compressed air used for pushing out the contents from the pipe system 101 to be overrun with air, thereby leaving too much of the pipe contents in the pipe system.

In function block 204 the estimated pipe contents travel speed $V_{contents}$ is determined on the basis of the air volume in the pipe system $V_{pipe}$ which has been supplied from the compressed air container 102 to the pipe system 101 in the push phase.

In block 203 the air volume in the pipe system $V_{pipe}$ is determined from the of air volume supplied from the compressed air container 102 which is calculated from the pressure drop $\Delta P_{container}$ in the compressed air container which occurs when the air is released from the compressed air container 102 into the pipe system 101, the compressed air container volume $V_{container}$ and the pressure $P_{pipe}$ in the pipe system.

In function block 204 a sequence of air volume values $V_{pipe}$ supplied to the pipe system 101 is determined from corresponding pressure measurements $P_{container}$ in the container 102 and the pipe system $P_{pipe}$. From there a sequence of changes in volume $\Delta V_{pipe}$ of the air in the pipe system 101 i.e. a flow into the pipe system is determined. By compensating the air volume changes $\Delta V_{pipe}$ in the pipe system for pipe diameter d in block 204, the estimated pipe contents travel speed $V_{contents}$ being the speed of the air front pushing the contents from the pipe system 101 can be determined.

Alternatively the normalized amount of air released from the compressed air container can be determined with an air flow meter positioned in the supply line 103. By adding up flow measurements in time, a normalized amount of air can be determined.

In subtractor 201 the estimated pipe contents travel speed $V_{contents}$ is subtracted from the set speed value $V_{set}$. With the calculated speed difference and a Proportional-Integration-Differentiation (PID) control function in block 202 a variable control signal is generated to control regulation valve 104. The regulation valve 104 causes a variable air flow from the compressed air container 102 into the pipe system 101.

The calculated estimate of the pipe contents travel speed $V_{contents}$ can be corrected for content viscosity with a contents speed correction factor F, which is determined by experiments using different products as pipe system contents. This prevents air to overflow the product near the end of the push phase, when most of the pipe contents have been pushed out of the pipe system 101.

While emptying the pipe system 101 from contents by filling it with compressed air from the compressed air container 102, the control unit 110 can determine that a predetermined threshold value of for example 85% of the air volume in the pipe system is exceeded, indicating that the contents are sufficiently expelled from the pipe system 101. The regulation valve 104 and/or the valve 106 can be closed, thereby ending the push phase.

In practice often the supply line 103 from the regulation valve 104 to the proximal end 115 of the pipe system has a non-negligible volume, affecting the calculation of the normalized amount of air released into the pipe system 101, as the normalized amount of air from the compressed air container first has to fill the supply line 103 as well. In a pre-push phase, the supply line 103 is filled with air up to a preset pressure value Ps measured by pressure sensor 105 air by opening regulation valve 104. When the preset pressure value Ps is attained the regulation valve 104 is closed again. The compressed air is then released into the pipe system in the push phase by opening valve 106. This connects the pipe system 106 to the supply line 103. Subsequently the pressure in the supply line 103 and pipe system 101 is regulated by the control system 110 and the regulation valve 104.

When the valve 106 is opened, the pressure in the pipe system 101 and the supply line 103 together is controlled by the control unit 110 by controlling regulation valve 104 on the basis of the estimated contents speed $V_{contents}$. The total amount of air supplied to the pipe system is now determined from air supplied from the air container 102 as described, and the air already in the supply line using the supply line volume $V_{supplyline}$, the pressure drop in the supply line, which is equal to the pressure drop in the pipe system $\Delta P_{pipe}$ since supply line 103 and pipe system 101 are now connected, and the pressure in the supply line and pipe system $P_{pipe}$.

Figure 3:
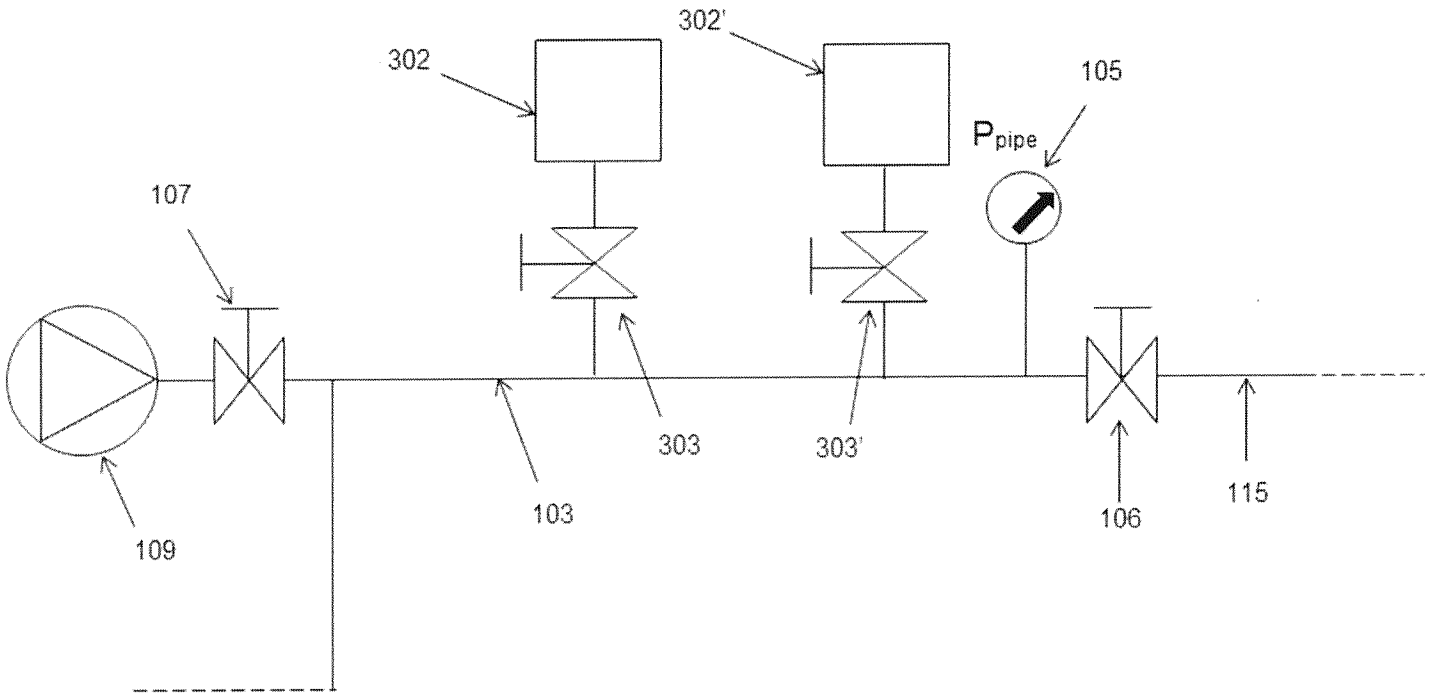
FIG. 3 shows a block diagram of a further embodiment of the system of FIG. 1 according to an embodiment of the invention.

In FIG. 3 fluid supplies 302, 302' are shown connected to supply line 103 via respective valves 303, 303'. The supply line 103 can be separated from the blower 109 via valve 107. In the blow phase 402 the blower 109 is switched on and valve 107 activated for providing a sufficient air flow in the pipe system 101 to sustain the outward motion of the remaining contents in the pipe system.

Remaining contents in the pipe system 101 may form fluid plugs which move from the proximal end 115 to the distal end 116 of the pipe system 101. In order to prevent mechanical vibration of the pipe system 101 caused by these fluid plugs, the blower 109 can be soft-started such that the pressure generated by blower 109 increases gradually at startup.

The rinse phase fluid supply 302 usually comprises water, but depending in the pipe contents, the rinse fluid composition may vary. Agents like detergents or disinfectants may be added to the rinse fluid.

As described, in a cleaning phase 405 instead of rinse fluid such as water, a cleaning fluid with a cleaning agent such as detergents or disinfectants can be injected from for example fluid supply 302' into the supply line 103 via valve 303'. A commonly used agent is for example sodium hypochlorite. After cleaning the pipe system 101, the pipe system 101 can be rinsed using rinsing fluid to remove the cleaning fluid as in the rinse phase and subsequently dried as in the drying phase as is the case in the process of clearing the pipe system 101. The combined blowing air in the supply line 103 using blower 109 and injecting a cleaning fluid with cleaning agent into the supply line 103, and the injected cleaning fluid is blown by the airflow in the supply line 103 into a spray.

The control unit 110 can comprise a programmable logic controller (PLC) or any other computing device having input ports for acquiring process data such as pressures, flows, etc. and output ports for controlling devices in the process such as valves, compressors, blowers.

The computing device may comprise a microprocessor or microcontroller connected to a memory having programming instructions which are executable on the computing device. The programming instructions can be stored in the memory such as EPROM, Flash memory, computer discs and other computer readable devices.

The described embodiments herein are given by way of example only. Deviations of and modifications to these examples can be made without departing from the scope of protection as et out in the claims below.

| REFERENCE NUMERALS | |
|---|---|
| 100 | system for clearing a pipe |
| 101 | pipe system |
| 102 | compressed air container |
| 103 | supply line |
| 104 | regulating valve |
| 105 | pressure sensor |
| 106 | proximal end valve |
| 107 | valve |
| 108 | compressor system |
| 109 | blower |
| 110 | control unit |
| 111 | outlet manifold |
| 112 | proximal end valve |
| 113 | preceding process |
| 114 | outlet |
| 114' | outlet |
| 114" | outlet |
| 115 | proximal end |
| 116 | distal end |
| 117 | pressure sensor |
| 118 | high pressure low volume compressor |
| 119 | valve |
| 200 | control system |
| 201 | subtraction |
| 202 | control function |
| 203 | air pressure to volume conversion |
| 204 | estimated contents travel speed calculation |
| 301 | valve |
| 302 | fluid supply |
| 302' | fluid supply |
| 303 | valve |
| 303' | valve |
| 400 | process stages |
| 401 | push |
| 402 | blow |
| 403 | rinse |
| 404 | dry |
| 405 | clean |
| 406 | dry |

The invention claimed is:

1. A method of clearing a pipe system from its contents, the pipe system having a proximal end and a distal end, the method comprising the steps of:

providing an air supply to the pipe system at the proximal end by applying an air pressure decreasing from an initial pressure as a bulk of the pipe contents get discharged gradually at the distal end for obtaining a contents flow in the pipe system;

the method further comprising:

determining a volume of air supplied to the pipe system by the air supply;

determining an estimated contents travel speed from the volume of the air supplied to the pipe system;

correcting the estimated contents travel speed for content viscosity with a contents speed correction factor F for obtaining a corrected estimated contents travel speed;

controlling the air supply at the proximal end of the pipe system for obtaining a predetermined pipe contents travel speed using the corrected estimated contents travel speed;

determining a position of an air-contents front in the pipe system based on a pressure at the proximal end thereof; and preventing the air supply to the proximal end of the pipe system upon determining that the position of the air-contents front in the pipe system corresponds to a predetermined position in the pipe system relative to the distal end thereof, said predetermined position corresponding to a position at which a sufficient amount of the contents is cleared from the pipe system.

2. The method according to claim 1, wherein controlling the air supply at the proximal end of the pipe system comprises controlling a regulation valve between the air supply and the proximal end of the pipe system.

3. The method according to claim 1, wherein the controlling the air supply to the proximal end of the pipe system comprises using a difference between the estimated contents travel speed and a preset contents travel speed value.

4. The method according to claim 1, wherein the air supply comprises a compressed air container having a container volume.

5. The method according to claim 4, wherein the determining a volume of air supplied to the pipe system comprises:

measuring a pressure in the compressed air container; and measuring a pressure at the proximal end of the pipe system;

calculating the air volume supplied to the pipe system from a pressure difference in the air container between an initial pressure and a pressure in the air container after supplying air from the air container to the pipe system.

6. The method according to claim 5, wherein the determining a volume of air supplied to the pipe system further comprises compensating the volume of air supplied to the pipe system for a supply line volume and an expansion of the air volume stored in the supply line prior to the supplying of the air to the pipe system.

7. The method according to claim 1, wherein the determining an estimated contents travel speed from the volume of the air supplied to the pipe system comprises determining a position of the air-contents front in the pipe system from the volume of air supplied to the pipe system by compensating the volume of air supplied to the pipe system with a pipe system diameter.

8. The method according to claim 7, wherein the determining an estimated contents travel speed from the volume of the air supplied to the pipe system further comprises:

calculating at least two positions of the air-contents front at least at two corresponding points in time; and calculating the estimated contents travel speed from the difference in the at least two positions and the time difference between the at least two respective points in time.

9. The method according to claim 1, wherein the predetermined position corresponds to a position at which at least 85% of the contents is cleared from the pipe system.

10. A system for clearing contents from a pipe system, the pipe system having a volume, a proximal end and a distal end, the system comprising:

an air supply connected to the pipe system proximal end for supplying air to the pipe system at the proximal end, wherein an air pressure decreases from an initial pressure as a bulk of the pipe system contents get discharged gradually at the distal end for obtaining a contents flow in the pipe system;

the system further comprising:

volume determining means for determining an air volume supplied by the air supply;

calculating means for determining an estimated contents travel speed from the volume of the air supplied to the pipe system and for correcting the estimated contents travel speed for content viscosity with a contents speed correction factor F for obtaining a corrected estimated contents travel speed;

control means arranged for controlling the air supply to the proximal end of the pipe system for obtaining a predetermined pipe contents travel speed using the corrected estimated contents travel speed;

position determining means configured and arranged for determining a position of an air-contents front in the pipe system based on a pressure at the proximal end thereof;

wherein the control means are configured and arranged for preventing the air supply to the proximal end of the pipe system upon determining that the position of the air-contents front in the pipe system corresponds to a predetermined position in the pipe system relative to the distal end thereof, said predetermined position corresponding to a position at which a sufficient amount of the contents is cleared from the pipe system.

11. The system according to claim 10, wherein the control means are arranged for controlling the air supply to the proximal end of the pipe system comprises using a difference between the estimated contents travel speed and a preset contents travel speed value.

12. The system according to claim 10, wherein the control means comprise a controllable valve for controlling the air supply to the proximal end of the pipe system and a controller, controllably connected to the controllable valve.

13. The system according to claim 12, wherein the controller comprises a PID-controller.

14. The system according to claim 10, wherein the air supply comprises a compressed air container having a container volume.

15. The system according to claim 14, wherein the volume determining means comprise:

a first pressure sensor for measuring a pressure in the compressed air container; and a second pressure sensor for measuring a pressure at the proximal end of the pipe system;

wherein the volume determining means are arranged further for calculating the air volume supplied to the pipe system from a pressure difference in the air container between an initial pressure and a pressure in the air container after supplying air from the air container to the pipe system, the air container volume, and a pressure at the proximal end of the pipe system after the supplying of the air into the pipe system.

16. The system according to claim 15, wherein the volume determining means are further arranged for compensating the air volume supplied to the pipe system for a volume of a supply line to the pipe system and an expansion of air in the supply line prior to supplying the air into the pipe system.

17. The system according to claim 10, wherein the calculating means for determining an estimated contents travel speed from the volume of the air supplied to the pipe system are further arranged for determining a position of the air-contents front in the pipe system between the supplied air and the contents in the pipe system from the volume of the air supplied to the pipe system and a pipe system cross section area.

18. The system according to claim 10, wherein the calculating means for determining an estimated contents travel speed are further arranged for:

calculating at least two positions of the air-contents front in the pipe system at least two corresponding time points;

calculating the estimated contents travel speed from a difference between the at least two positions at the at least two points in time and a time difference between the respective at least two point in time.

19. The system according to claim 10, wherein the predetermined position corresponds to a position at which at least 85% of the contents is cleared from the pipe system.

* * * * *